US012497781B2

(12) United States Patent
Brough

(10) Patent No.: US 12,497,781 B2
(45) Date of Patent: Dec. 16, 2025

(54) MULTIPART BRACKET AND RAINSCREEN CLADDING MOUNT SYSTEM INCLUDING SAME

(71) Applicant: METALLINE (SERVICES) LTD., Cannock (GB)

(72) Inventor: Darron Brough, Cannock (GB)

(73) Assignee: METALLINE (SERVICES) LTD., Cannock (GB)

( * ) Notice: Subject to any disclaimer, the term of this patent is extended or adjusted under 35 U.S.C. 154(b) by 197 days.

(21) Appl. No.: 18/547,562

(22) PCT Filed: Feb. 22, 2022

(86) PCT No.: PCT/GB2022/050489
§ 371 (c)(1),
(2) Date: Aug. 23, 2023

(87) PCT Pub. No.: WO2022/180386
PCT Pub. Date: Sep. 1, 2022

(65) Prior Publication Data

US 2024/0060310 A1 Feb. 22, 2024

(30) Foreign Application Priority Data

Feb. 23, 2021 (GB) ..... 2102531

(51) Int. Cl.
*E04F 13/08* (2006.01)
*E04F 13/00* (2006.01)

(52) U.S. Cl.
CPC ..... *E04F 13/0807* (2013.01); *E04F 13/007* (2013.01)

(58) Field of Classification Search
CPC ..... E04F 13/0807; E04F 13/0808; E04F 13/0814; E04F 13/0853; E04F 13/0855
See application file for complete search history.

(56) References Cited

U.S. PATENT DOCUMENTS

2011/0308187 A1* 12/2011 Berger ..... E04F 13/0855 52/582.1
2021/0293031 A1* 9/2021 Vernon ..... E04F 13/14

FOREIGN PATENT DOCUMENTS

DE 2708699 A1 9/1978
DE 3143125 A1 * 5/1983
(Continued)

OTHER PUBLICATIONS

International Search Report and Written Opinion in International Application No. PCT/GB2022/050489, dated Jun. 1, 2022, 10 pages.

(Continued)

*Primary Examiner* — Christine T Cajilig
(74) *Attorney, Agent, or Firm* — Day Pitney LLP; George Chaclas; Anthony A. Kassas

(57) ABSTRACT

A multipart bracket for rainscreen cladding, the bracket comprising a first component configured to be mounted relative to a vertical surface, the first component comprising an at least partially arcuate channel open on a side opposite to the vertical surface; and a second component with an at least partially arcuate, elongate spline received at least partially with the at least partially arcuate channel of the first component and a mounting portion to mount at least one panel relative thereto is provided as is a cladding assembly including one or more multipart bracket.

19 Claims, 12 Drawing Sheets

(56) References Cited

FOREIGN PATENT DOCUMENTS

| | | | | | |
|---|---|---|---|---|---|
| DE | 102006039653 | A1 | * | 6/2007 | ..... E04F 13/0808 |
| DE | 202019104819 | U1 | | 12/2020 | |
| EP | 0064290 | A1 | | 11/1982 | |
| EP | 0065296 | A1 | | 11/1982 | |
| EP | 0205793 | A2 | * | 12/1986 | |
| EP | 1406021 | A1 | | 4/2004 | |
| EP | 2194335 | A1 | | 6/2010 | |
| EP | 2476921 | A1 | * | 7/2012 | ..... E04B 1/7675 |
| EP | 3348746 | B1 | * | 4/2021 | ..... E04C 2/044 |
| WO | WO-8809415 | A1 | * | 12/1988 | |
| WO | WO-9312306 | A1 | * | 6/1993 | ..... E04F 13/0855 |

OTHER PUBLICATIONS

GB Search Report in Application No. GB2012531.7, dated Jul. 28, 2021, 4 pages.

* cited by examiner

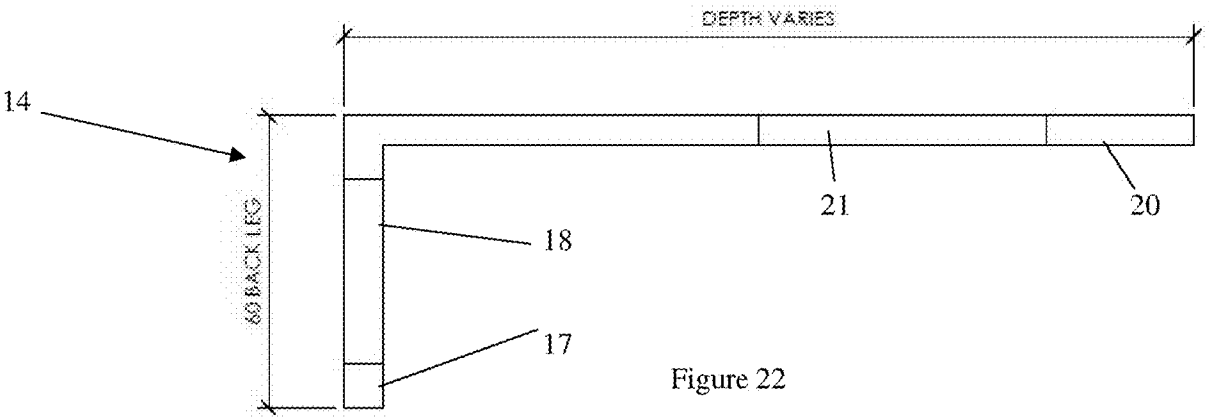
Figure 22
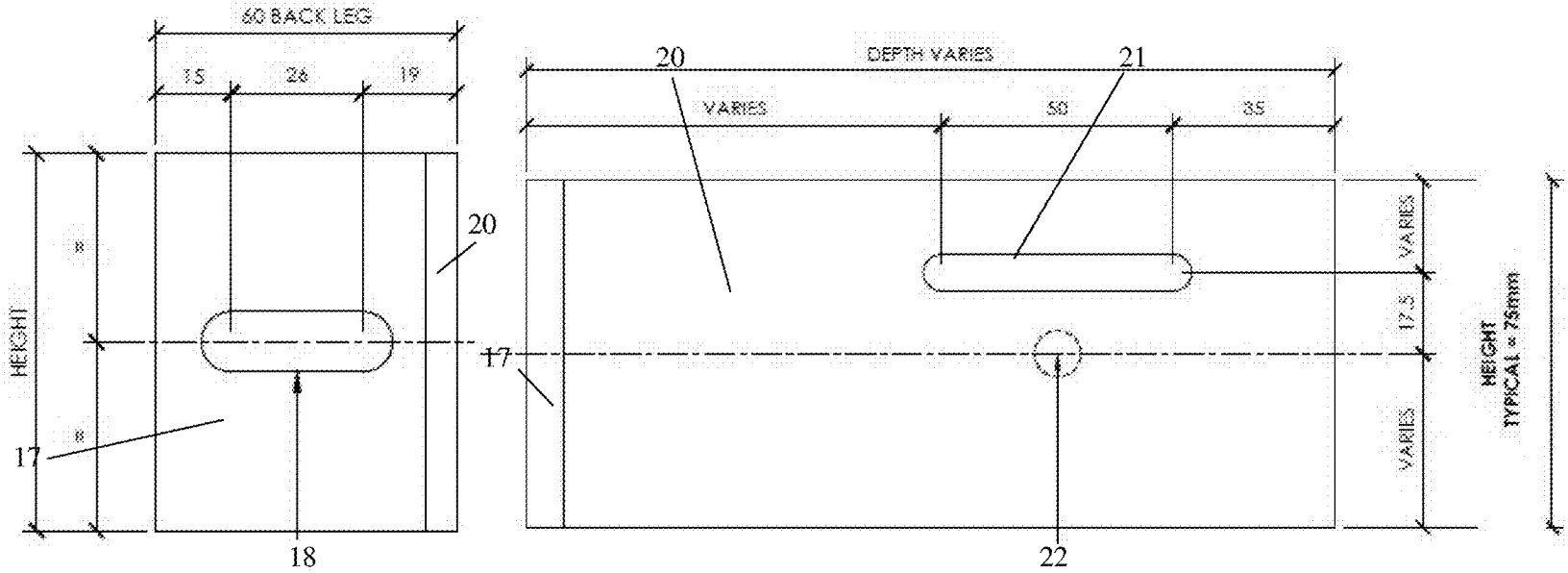
Figure 24
Figure 23

MULTIPART BRACKET AND RAINSCREEN CLADDING MOUNT SYSTEM INCLUDING SAME

CROSS-REFERENCED APPLICATIONS

The present application is a U.S. National Stage Application of International Application No. PCT/GB2022/050489 filed Feb. 22, 2022 and published on Sep. 1, 2022 as WO2022/180386 A1, which claims the benefit and priority of Great Britain Patent Application No. 2102531.7 filed on Feb. 23, 2021, each of which is incorporated herein by reference in its entirety for any purpose whatsoever.

FIELD OF THE DISCLOSURE

The present disclosure relates generally to the field of rainscreen cladding for buildings. In particular, but not exclusively, the disclosure concerns a bracket and a rainscreen cladding system including same.

BACKGROUND

It is known to apply an external façade to a building to create an air cavity between a load bearing wall and the cladding material. Rainscreen cladding has a variety of advantages including an increase in energy efficiency and ventilation inside the air cavity, improves the durability of the exterior cladding material, since it keeps it dry The cladding material, referred to as rainscreen cladding may be any type of material and typically also functions to keep inclement weather such as rain and snow away from the load bear structure of the building.

Sheets of cladding material are typically used. The sheets of cladding material are mounted relative to the load bearing structure using a system of rails mounted to the load bearing structure, typically to the external surface of the load bearing structure and then to which the sheets of cladding material are mounted. If the external surface of the load bearing structure is not square, then this can lead to the sheets of cladding being out of plumb, which can affect performance of the rainscreen cladding and at the very least, can be aesthetically displeasing.

Embodiments of the disclosure seek to at least partially overcome or ameliorate any one or more of the abovementioned disadvantages or provide the consumer with a useful or commercial choice.

SUMMARY

According to a first aspect of the disclosure there is provided a multipart bracket for rainscreen cladding, the bracket comprising a first component configured to be mounted relative to a vertical surface, the first component comprising an at least partially arcuate channel open on a side opposite to the vertical surface; and a second component with an at least partially arcuate, elongate spline received at least partially with the at least partially arcuate channel of the first component and a mounting portion to mount at least one panel relative thereto.

Providing a multipart bracket with a first component and a second component with the at least partially arcuate, elongate spline received at least partially with the at least partially arcuate channel allows the first component and second component to be pivotable relative to one another in one axis and slidable relative to one another in a second axis.

This allows the bracket to be adjusted to correct any misalignment of the structure which may not be truly planar or square.

The multipart bracket may be used as a part of a cladding assembly for mounting one or more cladding panels relative to a substantially vertical surface. The cladding assembly may be mounted relative to an exterior of a building, such as a rainscreen cladding assembly or relative to an interior space of a building such as a decorative façade for example.

The multipart bracket can be used in any application in which the ability to have rotational freedom in one direction and sliding movement and/or no movement in one or more other directions is needed.

The multipart bracket provides this movement whilst also spacing the cladding (mounted relative to the mounting portion of the second component) from the structure. The spacing of the one or more cladding panels from the substantially vertical surface typically creates an airflow space. Insulation may be provided between the one or more cladding panels and the substantially vertical surface. Any insulation is typically provided between the outside of the substantially vertical surface and the first component of the multipart bracket so that both an airflow space and insulation can be provided between the substantially vertical surface and the one or more cladding panels.

The multipart bracket includes a first component configured to be mounted relative to a vertical surface, the first component comprising an at least partially arcuate channel open on a side opposite to the vertical surface.

The first component may be mounted directly to the substantially vertical surface.

The first component is typically indirectly mounted relative to the substantially vertical surface. The multipart bracket may further include a third component to mount the first component relative to the vertical surface.

The third component may be an L-shaped member or assembly. Preferably, the L-shaped third component is provided as a unitary member. The L-shaped member typically has two arms at an angle to one another. The two arms will normally be perpendicular to one another.

A first arm of the L-shaped third component will normally be attached to or relative to an outer side vertical surface of a structure. The first arm may be planar. The attachment can utilise any method. One or more openings through the first arm may be provided. An elongate, slot opening may be provided with the length of the slot opening to provide flexibility in positioning of the third component. Usually, an elongate fastener such as a bolt or similar will be used to attach the first arm of the L-shaped third component.

A second arm typically extends from the first arm. The second arm may be planar. The length of the second arm is preferably such that a separation gap of a desired dimension is established between the vertical surface of a structure and the mounting portion of the multipart bracket. Typically, the L-shaped third component will be manufactured with a second arm in one of a number of standard lengths to suit different applications. One or more openings through the second arm may be provided. An elongate, slot opening may be provided. More than one opening may be provided through the second arm.

In an embodiment, an elongate slot opening is provided and a circular opening is also provided. One or more of the more than one opening may be formed on site. Typically, the elongate slot opening may be preformed and the circular opening may be formed on site.

Where more than one opening is provided through the second arm of the third component, the openings may be in different positions relative to one another depending upon the loading conditions for the third component and/or the multipart bracket.

An elongate fastener such as a bolt or similar is usually provided through each of the one or more openings in the second arm to locate and attach the first component of the multipart bracket to the second arm of the third component. Any elongate fastener used to locate and attach the first component to the second arm of the L-shaped third component may also function to hold the first component together and/or to clamp the elongate spline within the at least partially arcuate channel of the first component.

The third component is typically manufactured of a strong and robust material such as a metal but other materials with similar properties could be used such as a plastic or composite material. The shape of the third component is typically constant over its length or height.

The first component may be provided with one or more openings, into or through a part of the first component to receive the one or more fasteners associated with the preferred third component. Preferably, a pair of openings is provided. The openings will normally be circular openings.

The one or more openings preferably extend through the first component substantially transversely to the at least partially arcuate channel of the first component.

The one or more openings will normally be formed through a groove or similar portion in the first component. Typically, a vertical groove may be formed in each of opposed outer sides of the first component to form a narrowed portion of the first component through which the one or more fasteners can be located.

The first component may be formed in two halves. The halves are typically located relative to one another to form the at least partially arcuate channel and clamped together. As discussed above, the fasteners that attach the first component relative to the substantially vertical surface may also clamp the halves together.

Each of the halves of the first component may have the same configuration. Each half will typically be provided with a planar wall portion adjacent to an arcuate wall portion. The planar wall portion and arcuate wall portion are typically oriented facing an opposite half also having a planar wall portion and arcuate wall portion, the respective planar wall portions abutting and the respective arcuate wall portions facing one another to form the at least partially arcuate channel.

The planar wall portion typically extends from the top to the bottom of each of the halves of the first component.

The arcuate wall portion typically extends from the top to the bottom of each of the halves of the first component.

The arcuate wall portion will typically be approximately semi-circular. The arcuate wall portion will typically be open at the upper end and open at the lower end.

A shaped entry portion is typically provided in association with the arcuate wall portion, at a free end edge thereof. The shaped entry portion is typically angled such that when the halves are juxtaposed to form the at least partially arcuate channel, a convergent entry is formed into the at least partially arcuate channel. The angle of the shaped entry portion will typically define a limit of pivot of the second component relative to the first component. The preferred web of the second component (as described below) will typically extend through the convergent entry of the first component.

The planar wall portion may include a toothed surface. In an embodiment, a number of teeth may be provided over at least a portion of the planar wall portion. The teeth may be any shape, but a triangular shape may be preferred.

The arcuate wall portion may include a toothed surface. In an embodiment, a number of teeth may be provided over at least a portion of the arcuate wall portion. The teeth may be any shape, but a triangular shape may be preferred.

The toothed surfaces of respective halves may create a number of stable positions in movement or location. For example, the toothed surfaces of the respective planar wall portions will normally engage with each other to minimise movement of the halves relative to one another when fixed relative to one another. The toothed surfaces of the respective actuate wall portions will typically provide increased security of position of the elongate spline when located within the at least partially arcuate channel and fixed therein. Alternatively, if the elongate spline is also provided with an external toothed surface, the toothed surfaces of the respective actuate wall portions and the elongate spline may engage with each other to minimise movement of the elongate spline relative to the first component when fixed together.

On an outer side of each half (opposite to the planar wall portion and arcuate wall portion), an external configuration is typically provided to allow the mounting of the first component relative to the vertical surface. In an embodiment, the outer side of each half is provided with at least two, preferably three flanges. The flanges typically extend from the top of the half to the bottom of the half.

In an embodiment, the preferred three flanges are separated by two grooves. The provision of grooves allows a reduction in the amount of material used and therefore a reduction in weight. Each groove will typically extend from the top of the half to the bottom of the half. One of the grooves, a forward groove, is generally provided outside the arcuate portion. A second groove, a rear groove, is generally provided outside the planar wall portion. The second groove may be deeper than the first groove.

An outer edge of each flange is preferably planar. The respective outer edges are typically all coplanar. This allows the first component to be maintained in a square orientation to a surface or the second arm of the third component.

Each half will normally include at least one opening in the rear groove. Typically, two openings are provided. As described above, a fastener is normally provided through each opening and tightened to clamp the halves together (and preferably through an opening in the second arm of the third component to attach the first component to the third component).

The first component will typically be manufactured of a strong and robust material such as a metal but a plastic or composite material could be used.

The multipart bracket comprises a second component with an at least partially arcuate, elongate spline received at least partially with the at least partially arcuate channel of the first component and a mounting portion to mount at least one panel relative thereto.

The second component may be elongate. A single second component may be attached relative to one first component or relative to a number of aligned first components.

The elongate spline of the second component will normally be generally circular. The elongate spline may have a toothed external surface, or a partially toothed external surface.

The external dimension or circumference of the elongate spline is slightly greater than the dimension of the at least partially arcuate channel of the first component to allow the elongate spline to more effectively clamped within the at least partially arcuate channel of the first component.

A web extends radially outwardly from the elongate spline. The web is generally planar. The web is typically elongate, extending over the height (length) of the second component. A shaped bracing configuration may be provided at an outer end of the web (opposite to the elongate spline).

The dimension of the web from the elongate spline to the mounting portion is chosen according to the spacing required. Normally, the second component will be manufactured with a web of a dimension selected from a number of standard dimensions. The web may be provided in a selected thickness which may be greater or lesser depending on the application of the bracket.

The mounting portion is typically provided at or relative to an outer end of the web, opposite to the elongate spline.

The mounting portion may include a substantially planar wall. The substantially planar wall typically extends substantially perpendicularly to the web. The substantially planar wall may be provided in a selected thickness which may be greater or lesser depending on the application of the bracket. At least one cladding panel may be attached directly to the planar wall.

The substantially planar wall may be provided with at least one and typically at least a pair of mounting structures extending therefrom to allow attachment of a hook-on cassette.

The substantially planar wall typically extends an equal distance on each side of the web.

In this embodiment, the mounting structures may be L-shaped. A pair of mounting structures may extend from the substantially planar wall, oriented to define a generally U-shaped channel with an outer side of the substantially planar wall. The pair of mounting structures may face each other to define a generally rectangular opening with the substantially planar wall.

A first wall of each mounting structure may extend perpendicularly to the substantially planar wall. The first wall may be spaced inwardly (towards the web) from the free end of the substantially planar wall. This spacing creates a short extension outside the outer side of the first wall. This extension can function as an abutment stop for a hook.

A hook can be mounted relative to the outside of each of the first walls. The hooks can then engage with a hook-on cassette. The hook will typically be parallel to and abut the first wall. A fastener can be used to fix the hook to the first wall. The hook will preferably be planar when viewed from the front. The hook part of the hook will typically extend outside the plane of the second wall.

Each of the L-shaped mounting structures also typically includes a second wall, extending perpendicularly to the first wall. The second walls of the respective mounting structures will normally extend toward each other but the free ends of the second walls will normally be spaced apart. The second wall normally extends from an outer end of the first wall.

A joint strip or cover strip may be provided associated with the second walls of the respective mounting structures to cover any gap. Usually, the joint strip or cover strip is planar and mounted to the respective second walls.

A spacer may be provided between an outer face of the second wall and any cassette. The spacer may be resilient and thereby dampen any rattle which may occur due to tolerancing of the hooks and the cassette. A rebate may be provided in an outer face of the second wall to seat a spacer.

Any attachment opening in the mounting structure for attaching the hook or cladding panel or the like may be enlarged or reinforced. A tubular surround may be provided about any opening. If a tubular surround is provided on an inner side of the first wall, substantially parallel to the second wall, a part of the tubular surround may also provide a seating gap for a joint or cover strip.

The multipart bracket may be used with a clip associated with the second component. The clip may have a crook shape with a planar wall and an arcuate portion extending therefrom. In use, the clip is attached to the second component with the planar wall abutting one side of the web and the arcuate portion receiving a part of the elongate spline. The clip is then typically fixed to the second component, normally using one or more fasteners through openings in the planar portion and through the web.

The clip may be provided as a fixed point clip. When attached to the second component in the required position, one edge of the clip can abut an upper side of the first component to prevent the clip and the second component from slipping downwardly.

The clip may be provided as a sliding clip. If provided as a sliding clip, the clip will typically be taller than when provide as a fixed point clip. A sliding clip would typically be used to span any gap or space between an upper second component and a lower second component. The sliding clip may be attached to one of the second components (typically the upper second component) and not the other second component, allowing the respective second components to slide relative to one another guided by the crook shape with the arcuate portion of the sliding clip maintaining alignment by receiving the elongate spline of both the upper second component and the lower second component.

DETAILED DESCRIPTION

In order that the disclosure may be more clearly understood one or more embodiments thereof will now be described, by way of example only, with reference to the accompanying drawings, of which:

FIG. 22 is a top view of a primary bracket for a rainscreen cladding mount system used in wind load situations according to an embodiment.

FIG. 23 is a view from the right of the primary bracket shown in FIG. 22.

FIG. 24 is a view from the front of the primary bracket shown in FIG. 22.

Figure 1:
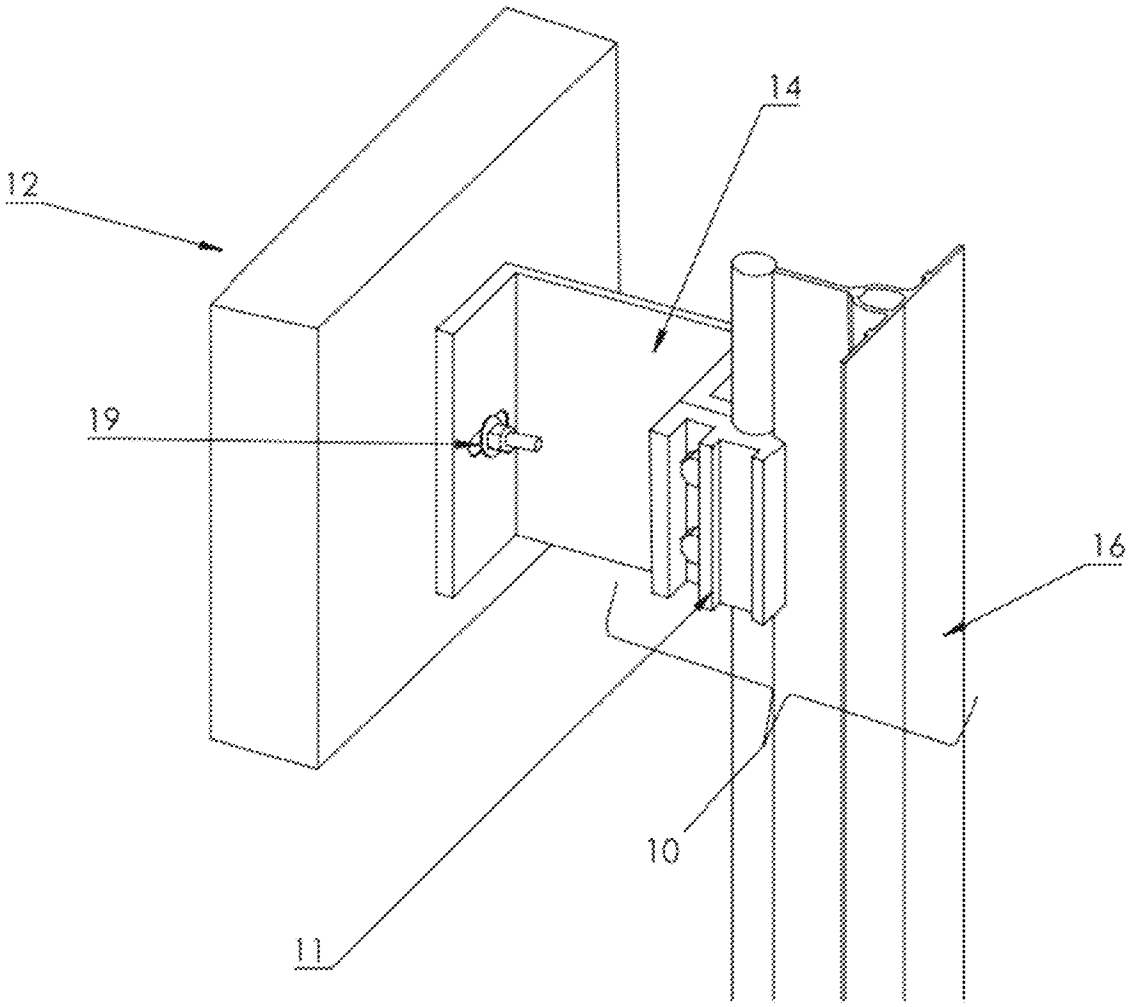
FIG. 1 is an axonometric view of one portion of a rainscreen cladding mount system including a multipart bracket of an embodiment.

With reference to the accompanying figures, a multipart bracket 10 for rainscreen cladding is illustrated.

The multipart bracket 10 comprises a first component 11 configured to be mounted relative to a vertical surface 12, the first component 11 comprising an at least partially arcuate channel open on a side opposite to the vertical surface 12 and a second component 13 with an at least partially arcuate, elongate spline 24 received at least partially with the at least partially arcuate channel 27 of the first component 11 and a mounting portion 26 to mount at least one panel 16 relative thereto.

Although not limited to this application, the multipart bracket 10 may be used as a part of a cladding assembly for mounting one or more cladding panels 16 relative to a substantially vertical surface 12. The cladding assembly may be mounted relative to an exterior of a building, such as a rainscreen cladding assembly or relative to an interior space of a building such as a decorative façade for example.

Figure 13:
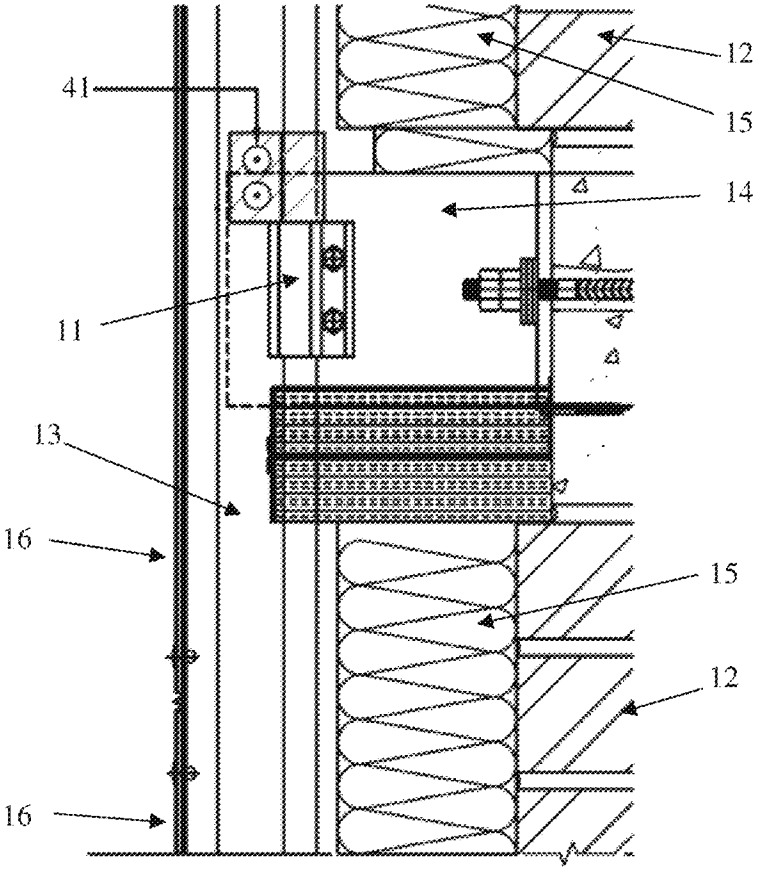
FIG. 13 is a side view of a rainscreen cladding mount system including a fixed-point mounting clip.
Figure 16:
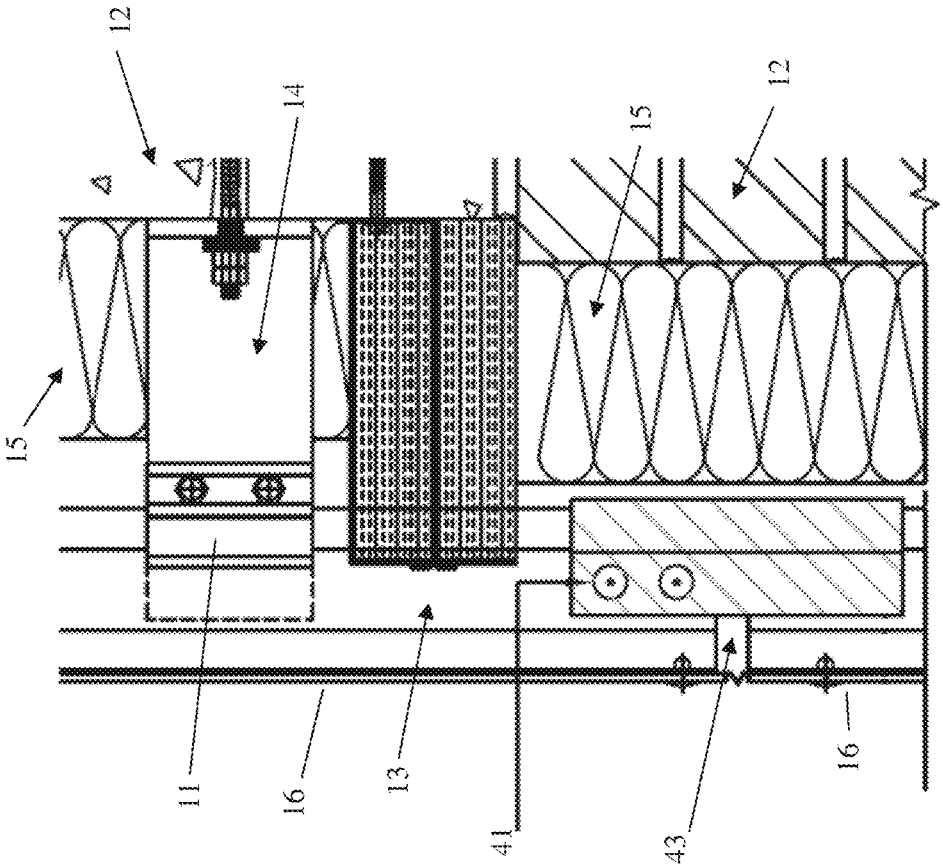
FIG. 16 is a side view of a rainscreen cladding mount system including a sliding mounting clip.

The multipart bracket provides rotational freedom in one direction and sliding movement and/or no movement in one or more other directions whilst also spacing the cladding (mounted relative to the mounting portion of the second component 13) from the structure 12. The spacing of the one or more cladding panels 16 from the substantially vertical surface typically creates an airflow space. As illustrated in FIGS. 13 and 16, insulation 15 may be provided between the one or more cladding panels 16 and the substantially vertical surface 12. Any insulation is typically provided between the outside of the substantially vertical surface 12 and the first component 11 of the multipart bracket 10 so that both an airflow space and insulation 15 can be provided between the substantially vertical surface 12 and the one or more cladding panels 16.

The first component 11 may be mounted directly to the substantially vertical surface 12 but usually, the first component 11 is typically indirectly mounted relative to the substantially vertical surface 12. As shown the multipart bracket 10 may further include a third component 14 (which may be referred to as a primary bracket given its position closest to the structure) to mount the first component 11 relative to the vertical surface 12.

As illustrated in FIGS. 1 and 22 to 27, the third component 14 is an L-shaped member with two arms perpendicular to one another.

A first arm 17 of the L-shaped third component 14 is attached to or relative to an outer side vertical surface of a structure 14. The first arm 17 is planar. The attachment can utilise any method. In the illustrated form, a slot opening 18 is provided through the first arm 17 with the length of the slot opening 18 to provide flexibility in positioning of the third component 14. Usually, an elongate fastener such as a bolt 19 or similar will be used to attach the first arm 17 of the L-shaped third component 14.

Figure 21:
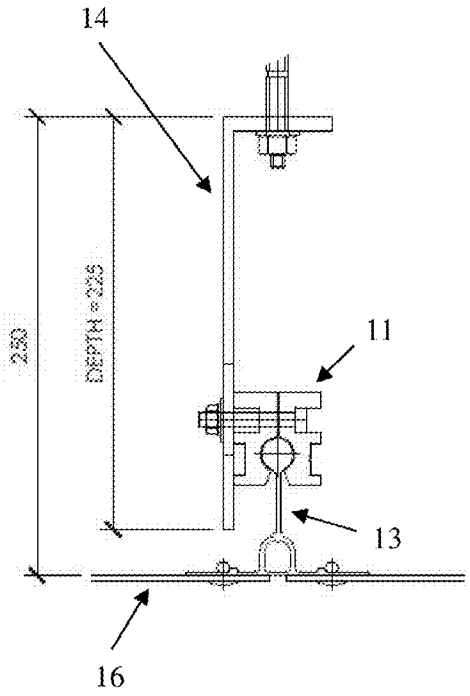
FIG. 21 is a top view of a rainscreen cladding mount system including a primary bracket of 250 mm in depth.
Figure 20:
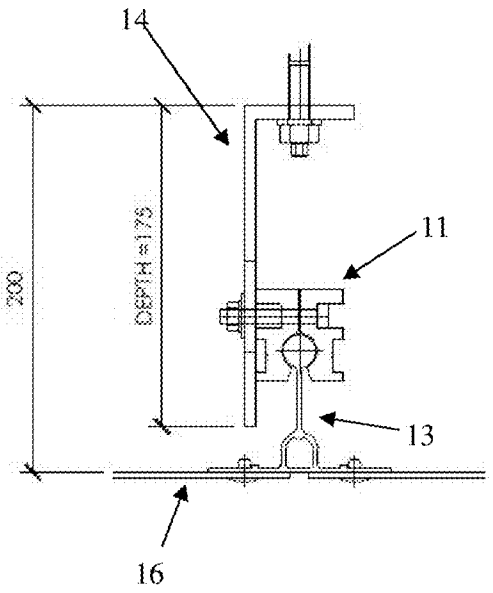
FIG. 20 is a top view of a rainscreen cladding mount system including a primary bracket of 175 mm in depth.
Figure 19:
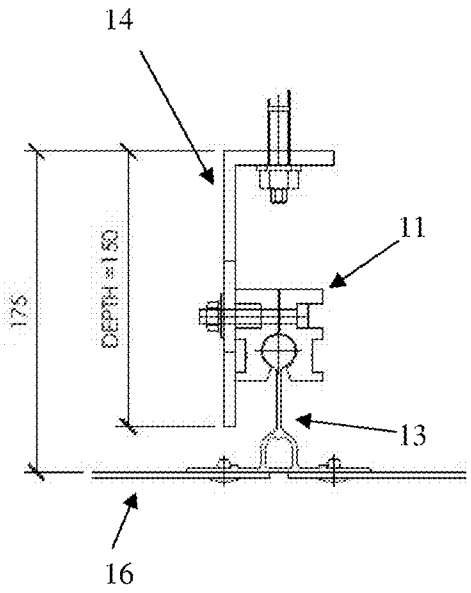
FIG. 19 is a top view of a rainscreen cladding mount system including a primary bracket of 150 mm in depth.

A second arm 20 extends from the first arm 17. The second arm 20 is also planar. The length of the second arm is preferably such that a separation gap of a desired dimension is established between the vertical surface of the structure 12 and the mounting portion of the multipart bracket 10. Typically, the L-shaped third component 14 is manufactured with a second arm 20 in one of a number of standard lengths to suit different applications or to provide different separation gap dimensions. An example of different sizes is shown in FIGS. 19 to 21.

In the illustrated embodiments, two openings through the second arm 20 are provided. An elongate slot opening 21 is provided and a circular opening 22 is also provided. Typically, the elongate slot opening 21 is preformed and the circular opening 22 may be formed on site.

Figure 25:
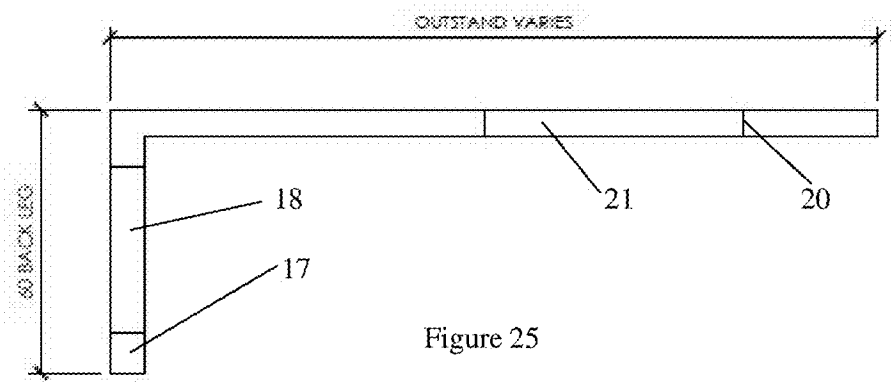
FIG. 25 is a top view of a primary bracket for a rainscreen cladding mount system used in dead load situations according to an embodiment.
Figure 27:
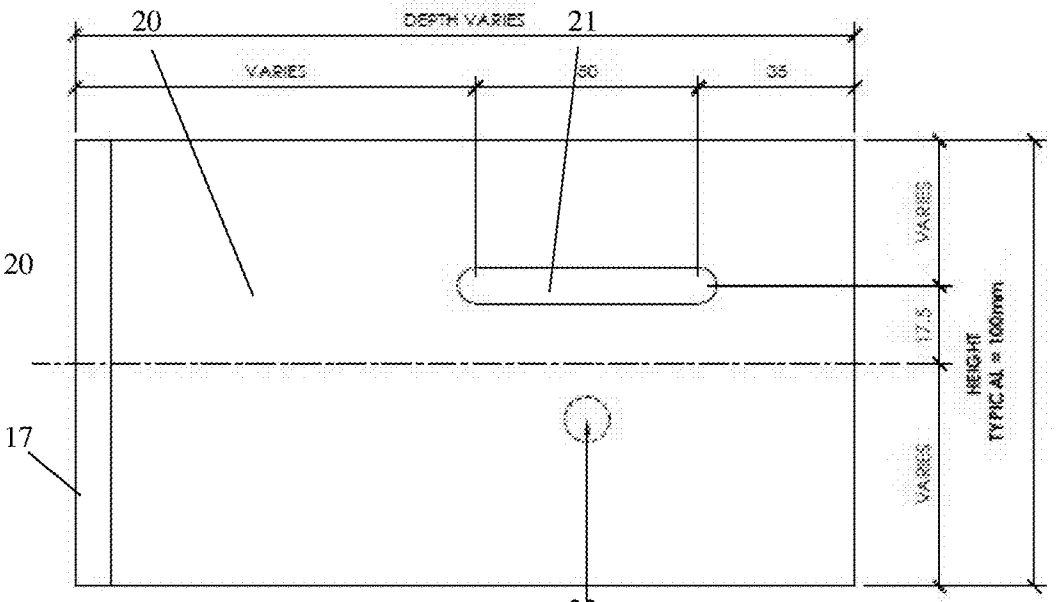
FIG. 27 is a view from the front of the primary bracket shown in FIG. 25.
Figure 26:
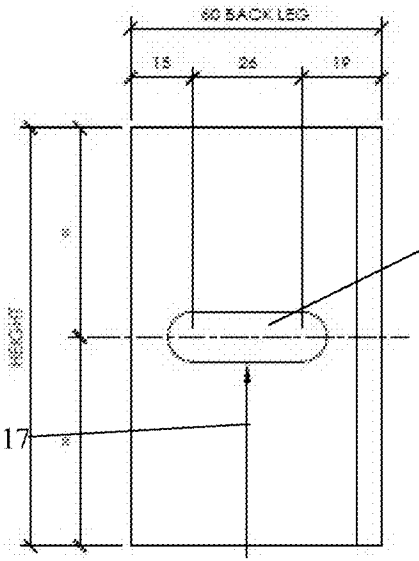
FIG. 26 is a view from the right of the primary bracket shown in FIG. 25.

The openings 21, 22 may be in different positions relative to one another depending upon the loading conditions for the third component 14 and/or the multipart bracket 10. In FIGS. 22 to 24, a primary bracket 14 for use in wind load conditions is illustrated in which the circular opening 22 is provided below the slot opening 21 and on the midline of the primary bracket 14. In FIGS. 25 to 27, a primary bracket 14 for use in dead load conditions is illustrated in which the circular opening 22 is provided below the slot opening 21 and below the midline of the primary bracket 14.

Figure 9:
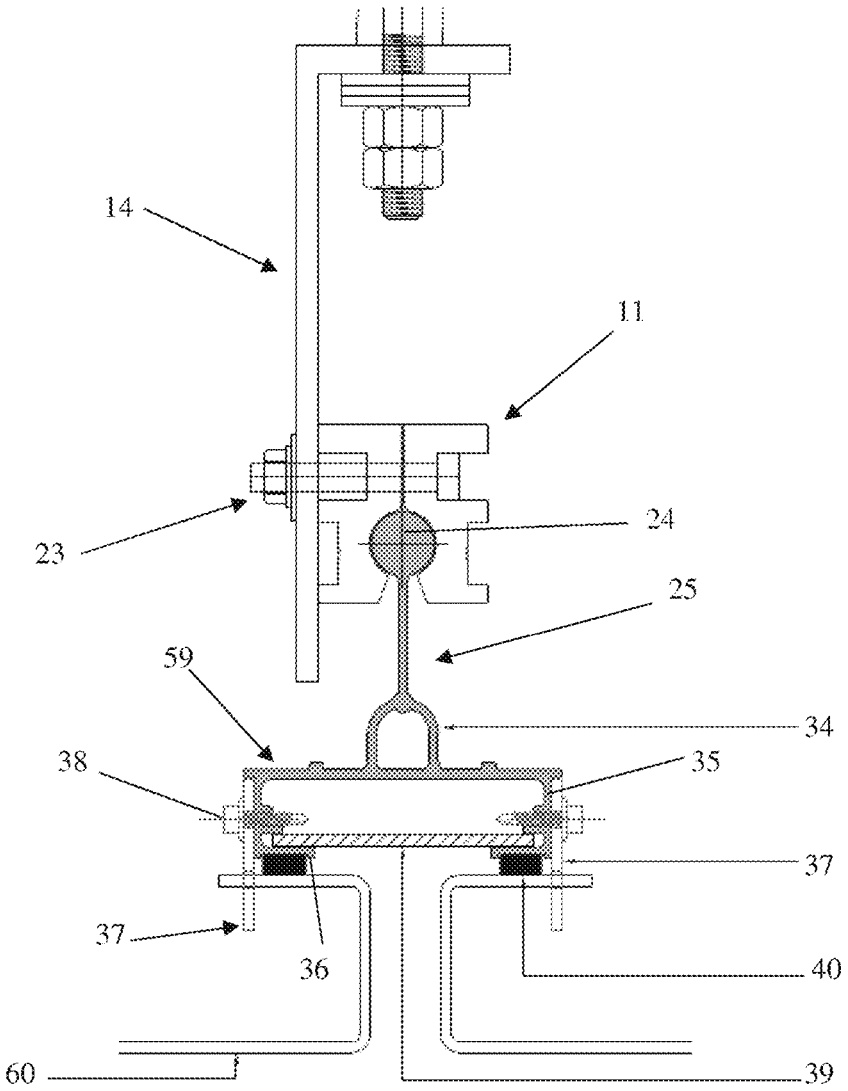
FIG. 9 is a top view of a rainscreen cladding mount system with a mounting rail configured for use with a hook-on cassette.
Figure 12:
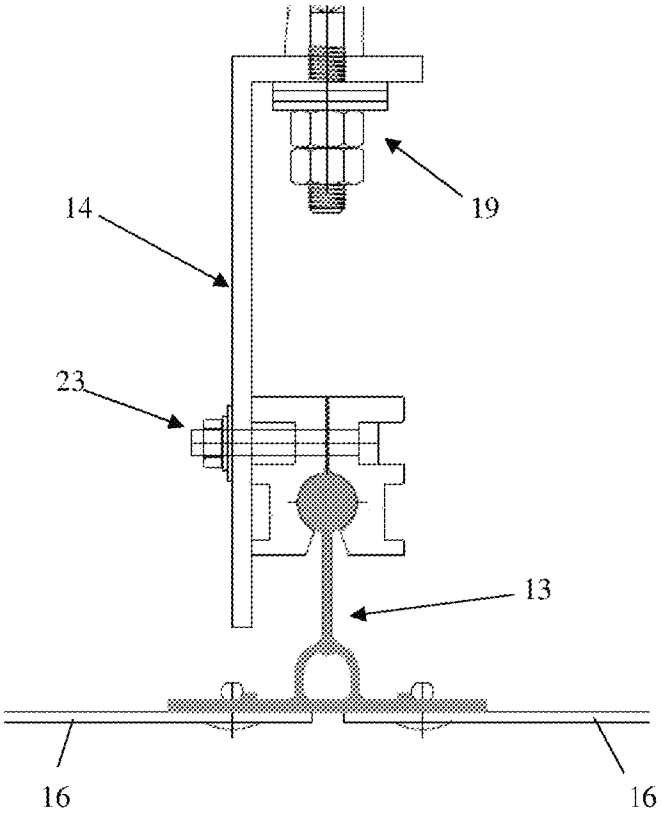
FIG. 12 is a top view of a rainscreen cladding mount system with another type of mounting rail with a 4 mm thick face.
Figure 11:
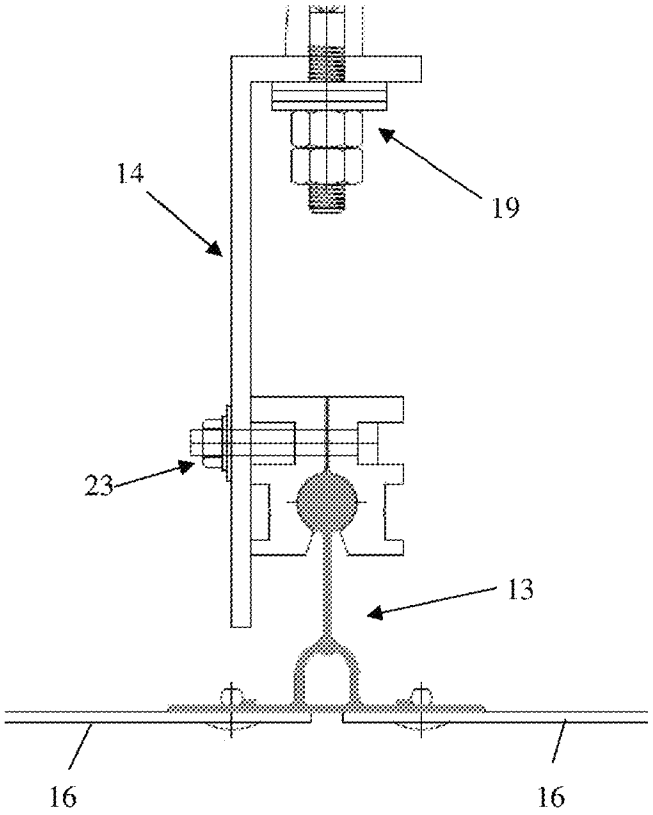
FIG. 11 is a top view of a rainscreen cladding mount system with an alternative type of mounting rail with a 2 mm thick face.

As shown in one of the top views such as FIG. 9, 11 or 12, an elongate fastener such as a bolt 19 is provided through each of the one or more openings 21, 22 in the second arm 20 to locate and attach the first component 11 of the multipart bracket 10 to the second arm 20 of the third component 14. The bolts 19 used to locate and attach the first component 11 to the second arm 20 of the L-shaped third component 14 also function to hold the first component 11 together (as will be described below) and/or to clamp the elongate spline 24 of the second component 13 within the at least partially arcuate channel 27 of the first component 11.

The third component 14 is typically manufactured of a strong and robust material such as a metal but other materials with similar properties could be used such as a plastic or composite material. The shape of the third component 14 is typically constant over its length or height.

As shown in FIGS. 5 to 8 in particular, the first component 11 may be formed in two halves. The halves of the first component are typically located relative to one another to form the at least partially arcuate channel 27 and clamped together. As discussed above, the bolts 23 that attach the first component 11 to the third component 14 and thereby relative to the substantially vertical surface 12, also clamp the halves of the first component 11 together.

Figure 5:
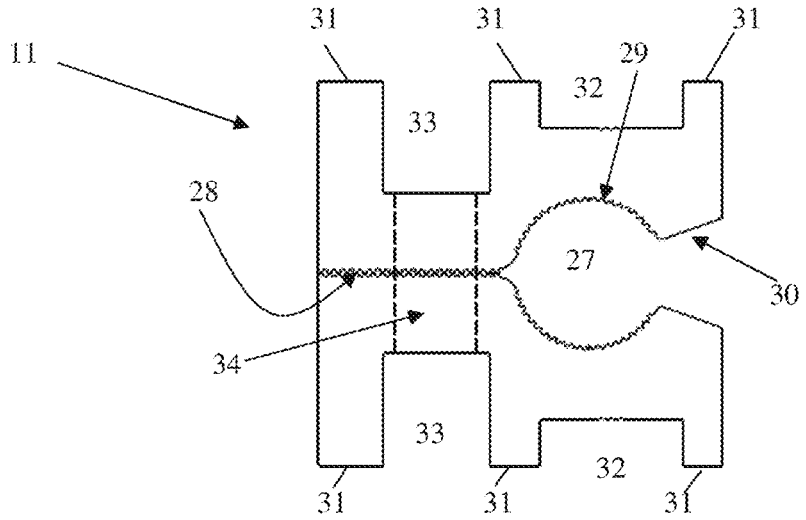
FIG. 5 is a top view of a first component of a multipart bracket of an embodiment.

Each of the halves of the first component 11 may have the same configuration. Each half will typically be provided with a planar wall portion 28 adjacent to an arcuate wall portion 29. The planar wall portion 28 and arcuate wall portion 29 are typically oriented facing an opposite half also having a planar wall portion 28 and arcuate wall portion 29, the respective planar wall portions 28 abutting and the respective arcuate wall portions 29 facing one another to form the at least partially arcuate channel 27 as shown in FIG. 5.

The planar wall portion 28 typically extends from the top to the bottom of each of the halves of the first component 11.

The arcuate wall portion 29 typically extends from the top to the bottom of each of the halves of the first component 11.

The arcuate wall portion 29 shown is approximately semi-circular. The arcuate wall portion 29 is open at the upper end and open at the lower end.

Figure 2:
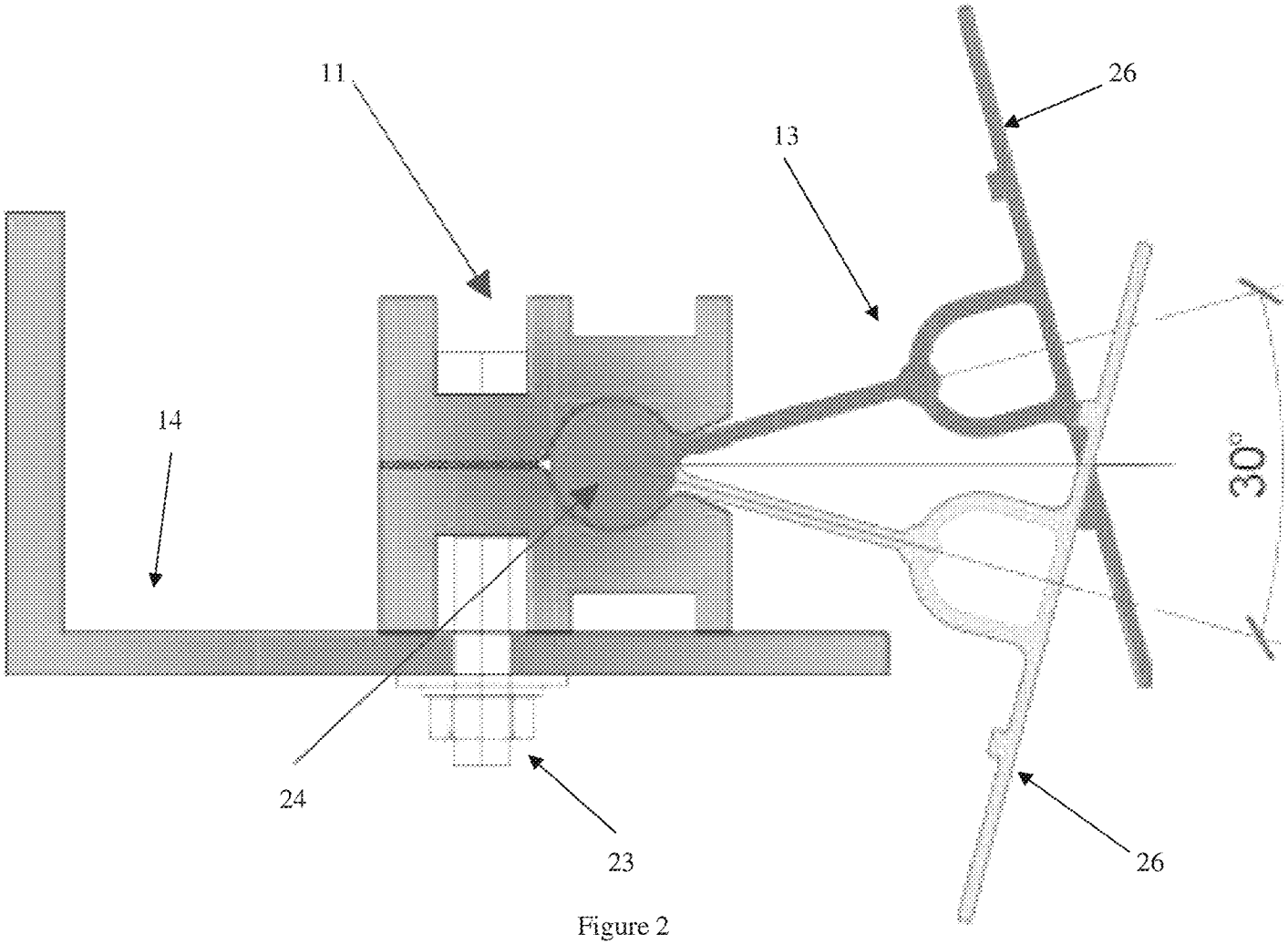
FIG. 2 is a top view of the configuration illustrated in FIG. 1.
Figure 3:
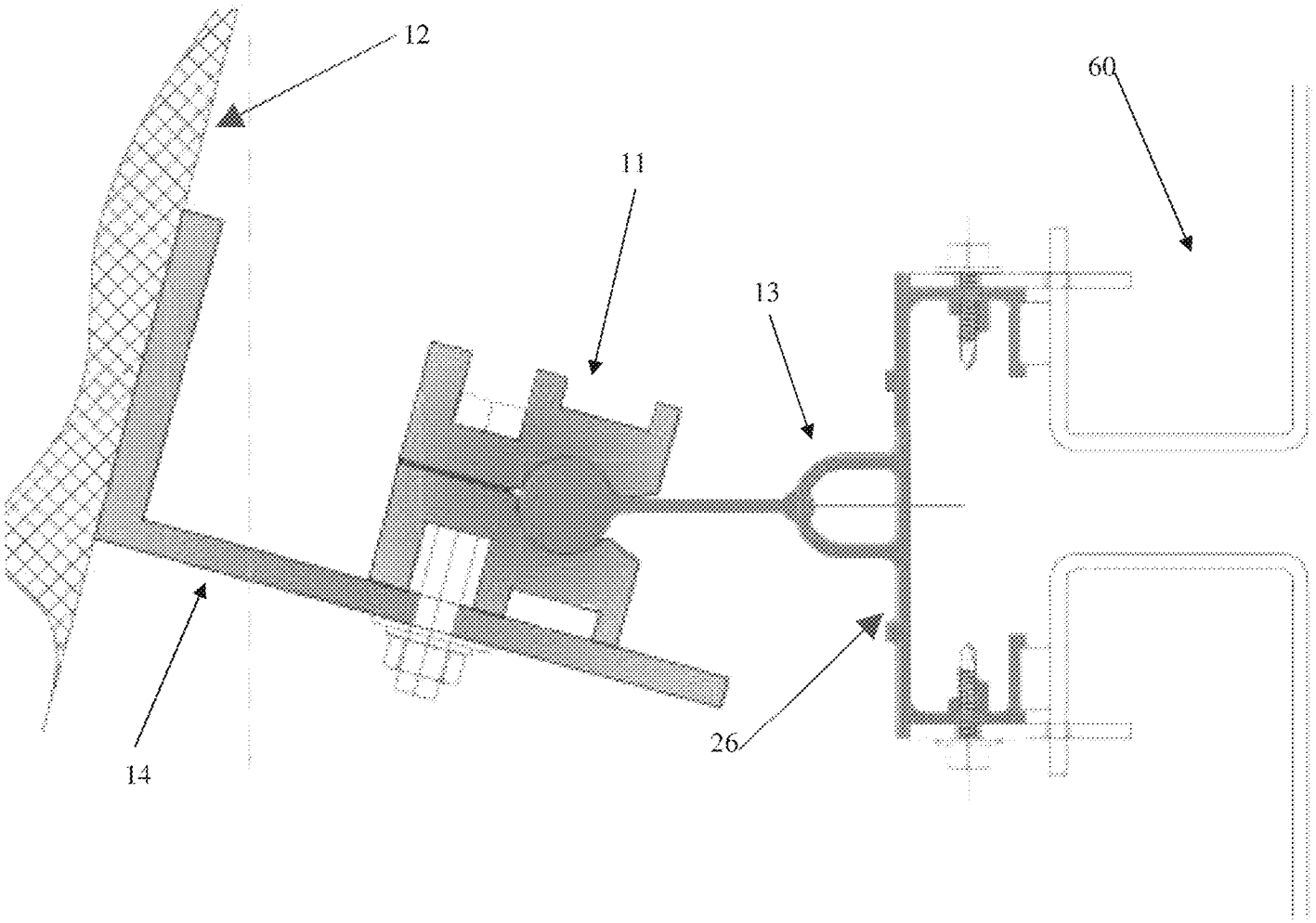
FIG. 3 is a top view of the configuration illustrated in FIG. 1 showing the use of the system.
Figure 4:
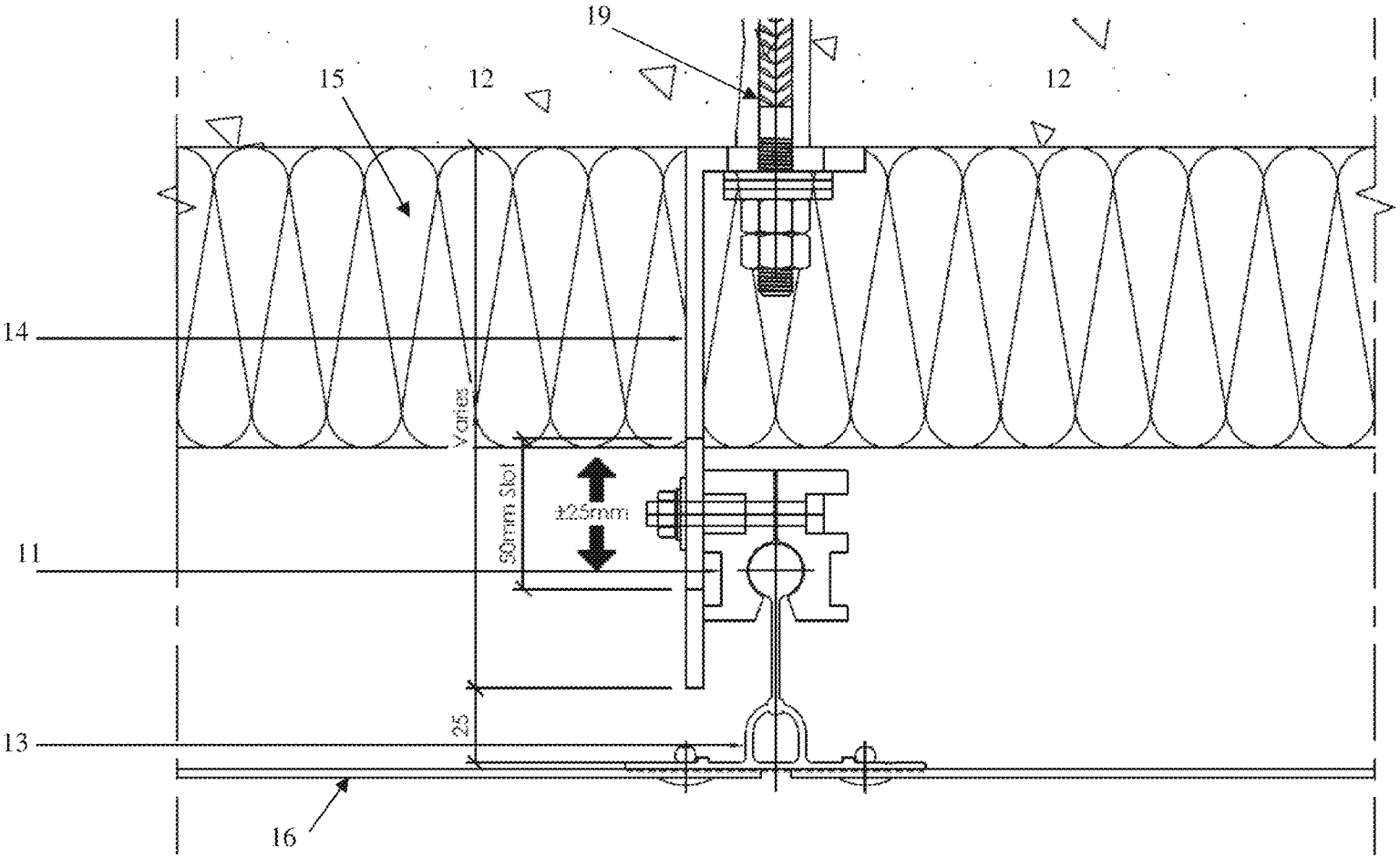
FIG. 4 is a schematic top view of a rainscreen cladding mount system showing a mounting arrangement.

A shaped entry portion 30 is typically provided in association with the arcuate wall portion 29, at a free end edge thereof. The shaped entry portion 30 is typically angled such that when the halves are juxtaposed to form the at least partially arcuate channel 27 as shown in FIG. 5, a convergent entry into the least partially arcuate channel 27 is formed. The angle of the shaped entry portion 30 will typically define a limit of pivot of the second component 13 relative to the first component 11 as shown in FIGS. 2 and 3. The web 25 of the second component 13 (as described below) will typically extend through the convergent entry of the first component 11.

The planar wall portion 28 may include a toothed surface as shown in FIG. 5, with a number of teeth provided over at least a portion of the planar wall portion 28. The teeth may be any shape, but a triangular shape may be preferred.

The arcuate wall portion 29 may include a toothed surface as shown in FIG. 5 with a number of teeth may be provided over at least a portion of the arcuate wall portion 29. The teeth may be any shape, but a triangular shape may be preferred.

The toothed surfaces of respective halves may create a number of stable positions in movement or location. For example, the toothed surfaces of the respective planar wall portions 28 will normally engage with each other to minimise movement of the halves relative to one another when fixed relative to one another. The toothed surfaces of the respective actuate wall portions 29 will typically provide increased security of position of the elongate spline 24 when located within the at least partially arcuate channel 27 and fixed therein. Alternatively, if the elongate spline 24 is also provided with an external toothed surface, the toothed surfaces of the respective actuate wall portions 29 and the elongate spline 24 may engage with each other to minimise rotational movement of the elongate spline 24 relative to the first component 11 when fixed together or provide indexed positions.

On an outer side of each half (opposite to the planar wall portion 28 and arcuate wall portion 29), an external configuration is typically provided to allow the mounting of the first component 11 relative to the vertical surface. In an embodiment, the outer side of each half is provided with at least two, preferably three flanges 31. The flanges 31 typically extend from the top of the half to the bottom of the half.

In an embodiment, the preferred three flanges 31 are separated by two grooves. The provision of grooves allows a reduction in the amount of material used and therefore a reduction in weight. Each groove will typically extend from the top of the half to the bottom of the half. One of the grooves, a forward groove 32, is generally provided outside the arcuate portion 29. A second groove, a rear groove 33, is generally provided outside the planar wall portion 28. The second groove 33 may be deeper than the first groove.

An outer edge of each flange 31 is preferably planar. The respective outer edges are typically all coplanar. This allows the first component 11 to be maintained in a square orientation to a surface or the second arm 20 of the third component 14.

Figure 6:
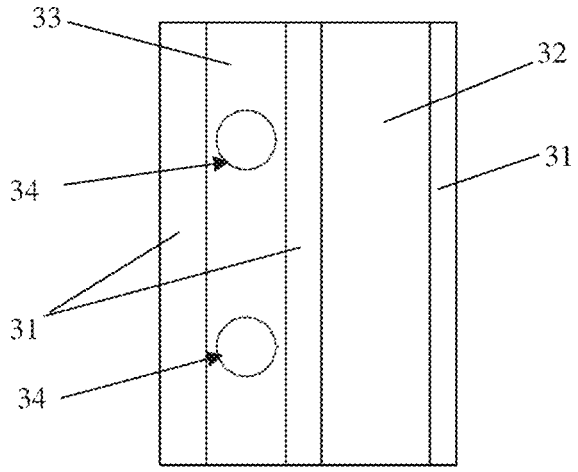
FIG. 6 is a side view of the first component illustrated in FIG. 5.
Figure 7:
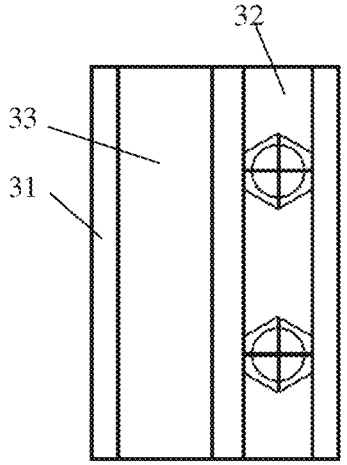
FIG. 7 is a side view of the first component illustrated in FIG. 5 showing the bolts used to mount the first component.
Figure 8:
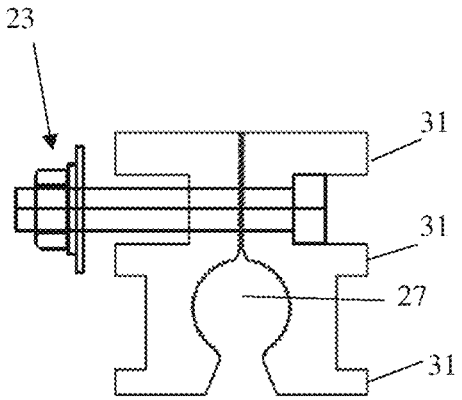
FIG. 8 is a top view of the first component illustrated in FIG. 7.

Each half will normally include at least one opening 34 in the rear groove 33. Typically, two openings 34 are provided as shown in FIG. 6 for example. The openings 34 receive the bolts 23 associated with the preferred third component 14. As The openings 34 will normally be circular openings.

The one or more openings 34 preferably extend through the first component 11 substantially transversely to the at least partially arcuate channel 27 of the first component 11.

As described above, a bolt 23 is normally provided through each opening 34 and tightened to clamp the halves together (and preferably through an opening 21, 22 in the second arm 20 of the third component 14 to attach the first component 11 to the third component 14).

The first component 11 will typically be manufactured of a strong and robust material such as a metal but a plastic or composite material could be used.

The second component 13 is typically elongate as shown in FIGS. 13 and 16. A single second component 13 may be attached relative to one first component 11 or relative to a number of aligned first components 11.

The elongate spline 24 of the second component 13 will normally be generally circular.

The external dimension or circumference of the elongate spline 24 is slightly greater than the dimension of the at least partially arcuate channel 27 of the first component 11 to allow the elongate spline 24 to more effectively clamped within the at least partially arcuate channel 27 of the first component 11.

A web 25 extends radially outwardly from the elongate spline 24. The web 25 is generally planar. The web 25 is typically elongate, extending over the height (length) of the second component 13. A shaped bracing configuration 34 may be provided at an outer end of the web (opposite to the elongate spline).

The dimension of the web 25 from the elongate spline 24 to the mounting portion 26 is chosen according to the spacing required. Normally, the second component 13 will be manufactured with a web 25 of a dimension selected from a number of standard dimensions. The web 25 may be provided in a selected thickness which may be greater or lesser depending on the application of the bracket. Different thicknesses are illustrated in FIGS. 11 and 12.

The mounting portion 26 is typically provided at or relative to an outer end of the web 25, opposite to the elongate spline 24. The mounting portion 26 may be as simple as a plate such as that shown in FIGS. 11 and 12 for example or a more complex mounting portion may be provided such as that illustrated in FIG. 9.

In a simple form, the mounting portion 26 may include a substantially planar wall. The substantially planar wall typically extends substantially perpendicularly to the web. The substantially planar wall may be provided in a selected thickness which may be greater or lesser depending on the application of the bracket. Different thicknesses are illustrated in FIGS. 11 and 12. At least one cladding panel 16 may be attached directly to the planar wall as shown in FIGS. 11 and 12, usually using a threaded fastener or a push plug.

The substantially planar wall typically extends an equal distance on each side of the web.

In a more complex form such as that illustrated in FIG. 9, the substantially planar wall 59 may be provided with at least one and typically at least a pair of mounting structures extending therefrom to allow attachment of a hook-on cassette 60.

In the illustrated embodiment, the mounting structures are L-shaped. A pair of mounting structures may extend from the substantially planar wall 59, oriented to define a generally U-shaped channel with an outer side of the substantially planar wall 59. The pair of mounting structures may face each other to define a generally rectangular opening with the substantially planar wall 59.

Figure 10:
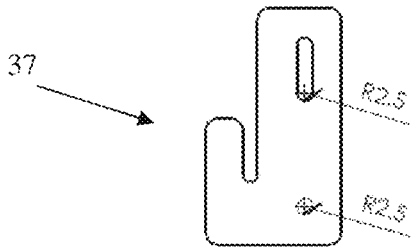
FIG. 10 is side view of a fixing hook used with the hook-on cassette of FIG. 9.

A first wall 35 of each mounting structure may extend perpendicularly to the substantially planar wall 59. The first wall 35 may be spaced inwardly (towards the web) from the free end of the substantially planar wall 59. This spacing creates a short extension outside the outer side of the first wall 35. This extension can function as an abutment stop for a hook (such as that illustrated in FIG. 10 used to attached the cassette 60).

A hook 37 can be mounted relative to the outside of each of the first walls 35. The hooks 37 can then engage with a hook-on cassette 60. The hook 37 will typically be oriented parallel to and abut the first wall 35. A fastener 38 can be used to fix the hook 37 to the first wall 35. The hook 37 will preferably be planar when viewed from the front (or top). The hook part of the hook 37 will typically extend outside the plane of the second wall 36.

Each of the L-shaped mounting structures also typically includes a second wall 36, extending perpendicularly to the first wall 35 and parallel to the substantially planar wall 59. The second walls 36 of the respective mounting structures will normally extend toward each other but the free ends of the second walls 36 will normally be spaced apart. The second wall 36 normally extends from an outer end of the first wall 35.

A joint strip or cover strip 39 may be provided associated with the second walls 36 of the respective mounting structures to cover any gap between adjacent hook-on cassettes 60. Usually, the joint strip or cover strip 39 is planar and mounted to the respective second walls 36.

A spacer 40 may be provided between an outer face of the second wall 36 and any cassette 60. The spacer 40 is normally resilient and thereby dampen any rattle which may occur due to tolerancing of the hooks 37 and the cassette 60. A rebate (obscured in FIG. 9) can be provided in an outer face of the second wall 36 to seat the spacer 40.

Any attachment opening in the mounting structure for attaching the hook or cladding panel or the like may be enlarged or reinforced. A tubular surround may be provided about any opening. If a tubular surround is provided on an inner side of the first wall, substantially parallel to the second wall, a part of the tubular surround may also provide a seating gap for the joint or cover strip 39. This configuration is illustrated in FIG. 9 but is difficult to see.

Figure 15:
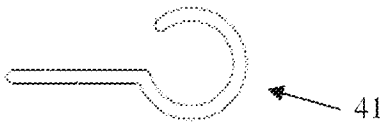
FIG. 15 is a top view of the fixed-point mounting clip illustrated in FIG. 14.
Figure 18:
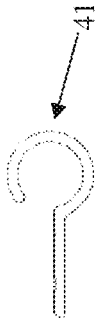
FIG. 18 is a top view of the sliding mounting clip illustrated in FIG. 17.

The multipart bracket 10 may be used with a clip 41 associated with the second component 13. The clip 41 may have a crook shape with a planar wall and an arcuate portion extending therefrom as shown in FIGS. 15 and 18. In use, the clip 41 is attached to the second component 13 with the planar wall of the clip 41 abutting one side of the web 25 and the arcuate portion of the clip 41 receiving a part of the elongate spline 24. The clip 41 is then typically fixed to the second component 13, normally using one or more fasteners 42 (plug or threaded) through one or more openings in the planar wall of the clip 41 and through the web 25 of the second component 13.

Figure 14:
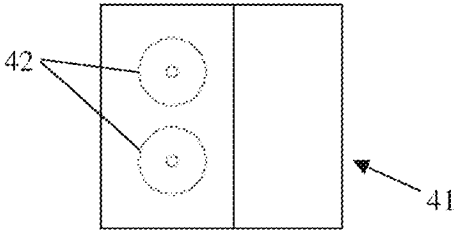
FIG. 14 is a side view of a fixed-point mounting clip of an embodiment.

The clip may be provided as a fixed point clip as shown in FIGS. 13 to 15. When attached to the second component 13 in the required position, one edge of the clip 41 can abut an upper side of the first component 11 as shown in FIG. 13, to prevent the clip 41 and the second component 13 from slipping downwardly.

Figure 17:
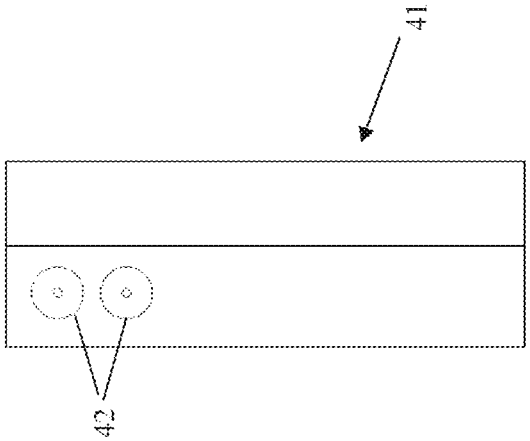
FIG. 17 is a side view of a sliding mounting clip of an embodiment.

The clip may be provided as a sliding clip as shown in FIGS. 16 to 18. If provided as a sliding clip, the clip 41 has the same shape as a clip provided as a fixed point clip but will typically be taller than when provide as a fixed point clip. A sliding clip would typically be used to span any gap or space 43 between an upper second component 13 and a lower second component 13. The sliding clip may be attached to one of the second components 13 (normally the upper second component) and not the other second component 13, allowing the respective second components 13 to slide relative to one another guided by the crook shape with the arcuate portion of the sliding clip maintaining alignment by receiving the elongate spline of both the upper second component 13 and the lower second component 13.

The one or more embodiments are described above by way of example only. Many variations are possible without departing from the scope of protection afforded by the appended claims.

What is claimed is:

1. A multipart bracket for rainscreen cladding, the bracket comprising:

a first component configured to be mounted relative to a vertical surface, the first component formed in two halves releasably clamped to one another to form an at least partially arcuate channel which extends parallel to the vertical surface and open on a side opposite to the vertical surface; and a second component with an at least partially arcuate, elongate spline received at least partially with the at least partially arcuate channel of the first component and a mounting portion to mount at least one panel relative thereto.

2. A multipart bracket as claimed in claim 1, further comprising a third component to mount the first component relative to the vertical surface, the third component mounted to the vertical surface and the first component mounted relative to the third component.

3. A multipart bracket as claimed in claim 2, wherein the third component is an L-shaped member or assembly with a first arm of the L-shaped member or assembly attached to or relative to an outer side vertical surface of a structure and a second arm extending from the first arm to mount the first component.

4. A multipart bracket as claimed in claim 1, wherein the first component is provided with one or more openings, into or through a part of the first component to receive one or more fasteners to mount the multipart bracket and/or to clamp the elongate spline within the at least partially arcuate channel of the first component.

5. A multipart bracket as claimed in claim 1, wherein each of the halves of the first component have the same configuration.

6. A multipart bracket as claimed in claim 1, wherein each half is provided with a planar wall portion adjacent to an arcuate wall portion.

7. A multipart bracket as claimed in claim 6, wherein the planar wall portion and arcuate wall portion are oriented facing an opposite half also having a planar wall portion and arcuate wall portion, the respective planar wall portions abutting and the respective arcuate wall portions facing one another to form the at least partially arcuate channel.

8. A multipart bracket as claimed in claim 6, wherein the planar wall portion includes a toothed surface.

9. A multipart bracket as claimed in claim 6, wherein the arcuate wall portion includes a toothed surface.

10. A multipart bracket as claimed in claim 1 wherein each half includes at least one opening in a portion of the half behind the at least partially arcuate channel to receive a fastener therethrough to clamp the halves together.

11. A multipart bracket as claimed in claim 1 wherein the elongate spline of the second component is generally circular in cross-sectional shape.

12. A multipart bracket as claimed in claim 1, wherein an external dimension or circumference of the elongate spline is slightly greater than a dimension of the at least partially arcuate channel of the first component to allow the elongate spline to be clamped within the at least partially arcuate channel of the first component.

13. A multipart bracket as claimed in claim 1, wherein a web extends radially outwardly from the elongate spline.

14. A multipart bracket as claimed in claim 13, wherein the mounting portion is provided at or relative to an outer end of the web, opposite to the elongate spline.

15. A multipart bracket as claimed in claim 1, wherein the mounting portion includes a substantially planar wall.

16. A multipart bracket as claimed in claim 1, wherein the second component is substantially T-shaped in section including a planar web extending radially from the elongate spline and a substantially planar wall extending substantially perpendicularly to the planar web.

17. A multipart bracket as claimed in claim 15, wherein the substantially planar wall is provided with at least one mounting structure extending therefrom to allow attachment of a hook-on cassette.

18. A multipart bracket as claimed in claim 1, further including a clip having a crook shape with a planar wall and an arcuate portion extending therefrom associated with the elongate spline of the second component.

19. A cladding assembly for mounting one or more cladding panels relative to a substantially vertical surface comprising at least one multipart bracket as claimed in claim 1, and one or more cladding panels mounted to the mounting portion of at least one of the multipart brackets.

* * * * *